US008839874B2

(12) United States Patent
Bishop et al.

(10) Patent No.: US 8,839,874 B2
(45) Date of Patent: Sep. 23, 2014

(54) PACKING ELEMENT BACKUP SYSTEM

(75) Inventors: David S. Bishop, Houston, TX (US); Antonio C. Ruffo, Cypress, TX (US); Douglas J. Lehr, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 319 days.

(21) Appl. No.: 13/472,128

(22) Filed: May 15, 2012

(65) Prior Publication Data

US 2013/0306331 A1 Nov. 21, 2013

(51) Int. Cl.
*E21B 33/12* (2006.01)

(52) U.S. Cl.
USPC ..... 166/387; 166/191; 166/179

(58) Field of Classification Search
USPC ..... 166/387, 191, 179, 123, 386
See application file for complete search history.

(56) References Cited

U.S. PATENT DOCUMENTS

| | | | |
|---|---|---|---|
| 927,874 | A | 7/1909 | Robinson |
| 2,069,212 | A | 2/1937 | Buffington |
| 2,196,668 | A | 4/1940 | Ragan |
| 2,289,164 | A | 7/1942 | Arnold et al. |
| 2,330,425 | A | 9/1943 | Hilton |
| 2,464,713 | A | 3/1949 | Penick |
| 2,467,822 | A | 4/1949 | Griffin et al. |
| 2,604,946 | A | 7/1952 | Sweet |
| 2,720,267 | A | 10/1955 | Brown |
| 2,743,781 | A | 5/1956 | Lane |
| 2,789,004 | A | 4/1957 | Foster |
| 2,812,025 | A | 11/1957 | Teague et al. |
| 2,880,806 | A | 4/1959 | Davis |
| 2,970,651 | A | 2/1961 | Roberts |
| 3,036,639 | A | 5/1962 | Baker |
| 3,085,627 | A | 4/1963 | Sodich |
| 3,171,492 | A | 3/1965 | Cochran |
| 3,268,275 | A | 8/1966 | Laughlin |

(Continued)

FOREIGN PATENT DOCUMENTS

| | | | |
|---|---|---|---|
| GB | 2230800 | A | 10/1990 |
| GB | 2 406 593 | A | 4/2005 |
| WO | WO 86/02971 | | 5/1986 |
| WO | WO 95/23908 | | 9/1995 |

OTHER PUBLICATIONS

J.D. Burley, et al., Recent Developments in Packer Seal Systems for Sour Oil and Gas Wells, Oct. 9-12, 1977, pp. 1-8, SPE 6762, American Institute of Mining, Metallurgical, and Petroleum Engineers, Inc., U.S.A.

(Continued)

*Primary Examiner* — Yong-Suk (Philip) Ro
(74) *Attorney, Agent, or Firm* — Shawn Hunter

(57) ABSTRACT

Downhole tool packing element systems comprise a sealing element having a support system. The support system can include one or more of a first spacer ring, a second spacer ring, a third spacer ring, a mesh ring, and one or more petal rings. One or more of these components can be disposed at one or both of the upper end and/or lower end of the sealing element. When compressed, the sealing element is moved radially outward to engage an inner wall surface of a wellbore due to compressive forces of the one or more spacer ring(s), mesh ring, and/or petal ring(s). The lower end of one or more of the mesh ring(s) and/or petal ring(s) rotate outwardly toward the casing and engage the casing to facilitate creation of the seal.

21 Claims, 6 Drawing Sheets

(56) References Cited

U.S. PATENT DOCUMENTS 3,364,993 A 1/1968 Skipper
3,436,084 A 4/1969 Courter
3,554,280 A * 1/1971 Tucker ..... 166/134
3,926,254 A 12/1975 Evans et al.
3,952,656 A 4/1976 Fox et al.
4,258,926 A 3/1981 Upton
4,285,400 A 8/1981 Mullins, II
4,313,495 A 2/1982 Brandell
4,441,551 A 4/1984 Biffle
4,452,463 A 6/1984 Buckner
4,458,752 A 7/1984 Brandell
4,469,172 A 9/1984 Clark
4,488,740 A 12/1984 Baugh et al.
4,573,537 A 3/1986 Hirasuna et al.
4,615,544 A 10/1986 Baugh
4,685,516 A 8/1987 Smith et al.
4,697,640 A * 10/1987 Szarka ..... 166/120
4,706,746 A 11/1987 White et al.
4,729,430 A 3/1988 White et al.
4,753,444 A * 6/1988 Jackson et al. ..... 277/342
4,787,446 A 11/1988 Howell et al.
4,793,424 A 12/1988 Lim, Jr.
4,877,086 A 10/1989 Zunkel
4,900,067 A 2/1990 Jansen et al.
5,097,902 A 3/1992 Clark
5,193,616 A 3/1993 Hynes
5,203,412 A 4/1993 Doggett
5,207,272 A 5/1993 Pringle et al.
5,220,959 A 6/1993 Vance, Sr.
5,236,047 A 8/1993 Pringle et al.
5,257,663 A 11/1993 Pringle et al.
5,291,947 A 3/1994 Stracke
5,320,182 A 6/1994 Mendez
5,327,962 A 7/1994 Head
5,343,963 A 9/1994 Bouldin et al.
5,390,737 A * 2/1995 Jacobi et al. ..... 166/184
5,466,537 A 11/1995 Diede et al.
5,540,280 A 7/1996 Schultz et al.
5,542,473 A 8/1996 Pringle
5,577,560 A 11/1996 Coronado et al.
5,613,557 A 3/1997 Blount et al.
5,701,959 A 12/1997 Hushbeck et al.
5,833,001 A 11/1998 Song et al.
5,849,188 A 12/1998 Voll et al.
5,849,198 A 12/1998 Sharpless
5,936,913 A 8/1999 Gill et al.
5,975,205 A 11/1999 Carisella
6,006,835 A 12/1999 Onan et al.
6,009,951 A 1/2000 Coronado et al.
6,055,213 A 4/2000 Rubbo et al.
6,102,117 A 8/2000 Swor et al.
6,102,120 A 8/2000 Chen et al.
6,142,227 A 11/2000 Hiorth et al.
6,173,788 B1 1/2001 Lembcke et al.
6,173,969 B1 1/2001 Stoll et al.
6,203,020 B1 3/2001 Mireles, Jr. et al.
6,341,654 B1 1/2002 Wilson et al.
6,343,796 B1 2/2002 Lee et al.
6,361,049 B1 3/2002 Joco
6,390,479 B1 5/2002 Combet et al.
6,431,273 B1 8/2002 McGarian et al.
6,497,416 B1 12/2002 Morvant
6,571,876 B2 6/2003 Szarka
6,626,243 B1 9/2003 Go Boncan
6,712,153 B2 3/2004 Turley et al.
6,769,491 B2 8/2004 Zimmerman et al.
6,772,844 B2 8/2004 Lloyd et al.
6,779,601 B2 8/2004 Wilson et al.
6,798,350 B2 9/2004 Maxit et al.
6,827,150 B2 * 12/2004 Luke ..... 166/387
6,834,725 B2 12/2004 Whanger et al.
6,843,315 B2 1/2005 Coronado et al.
6,843,480 B2 1/2005 Nelson et al.
6,854,522 B2 2/2005 Brezinski et al.
6,962,206 B2 11/2005 Hirth et al.
7,165,622 B2 1/2007 Hirth et al.
7,188,691 B2 3/2007 Yong et al.
7,204,525 B2 4/2007 Matzner
7,210,533 B2 5/2007 Starr et al.
7,213,814 B2 5/2007 Hurlbert et al.
7,322,410 B2 1/2008 Vinegar et al.
7,331,581 B2 2/2008 Xu et al.
7,363,970 B2 4/2008 Corre et al.
7,387,165 B2 6/2008 Lopez de Cardenas et al.
7,448,445 B2 11/2008 Doane et al.
7,478,679 B2 1/2009 Berzin et al.
7,610,964 B2 11/2009 Cox
7,617,880 B2 11/2009 Loughlin
7,703,542 B2 4/2010 O'Connor et al.
7,726,407 B2 6/2010 Wood et al.
7,743,835 B2 6/2010 Willauer
7,748,468 B2 7/2010 Casciaro
7,806,177 B2 10/2010 Bishop et al.
7,806,192 B2 10/2010 Foster et al.
7,806,193 B2 10/2010 Berzin et al.
7,845,402 B2 12/2010 O'Connor et al.
7,886,818 B1 2/2011 O'Connor et al.
7,891,433 B2 2/2011 Vinson et al.
7,931,093 B2 4/2011 Foster et al.
7,938,192 B2 5/2011 Rytlewski
8,016,295 B2 9/2011 Guest et al.
8,037,942 B2 10/2011 Vinson et al.
2003/0080515 A1 5/2003 Milberger et al.
2003/0131988 A1 7/2003 Wilson et al.
2004/0112609 A1 6/2004 Whanger et al.
2004/0129432 A1 7/2004 Wills et al.
2004/0134659 A1 7/2004 Hoffman et al.
2005/0023003 A1 2/2005 Echols et al.
2005/0067170 A1 3/2005 Richard
2005/0161229 A1 7/2005 Doane et al.
2005/0199401 A1 9/2005 Patel et al.
2005/0284633 A1 12/2005 Richard
2006/0124310 A1 6/2006 Lopez de Cardenas et al.
2006/0186602 A1 8/2006 Martin et al.
2007/0039160 A1 2/2007 Turley et al.
2007/0056725 A1 3/2007 Lucas et al.
2007/0125532 A1 6/2007 Murray et al.
2007/0144734 A1 6/2007 Xu et al.
2007/0193736 A1 8/2007 Corre et al.
2007/0289749 A1 12/2007 Wood et al.
2007/0290454 A1 12/2007 Garrison et al.
2008/0060821 A1 * 3/2008 Smith et al. ..... 166/387
2008/0073086 A1 * 3/2008 Cook et al. ..... 166/387
2008/0087417 A1 4/2008 Doane et al.
2008/0110625 A1 5/2008 Arcement et al.
2008/0135260 A1 6/2008 Berzin et al.
2008/0149351 A1 6/2008 Marya et al.
2008/0156501 A1 7/2008 Vinson et al.
2008/0264647 A1 10/2008 Li
2008/0283236 A1 11/2008 Akers et al.
2008/0302543 A1 12/2008 O'Connor et al.
2009/0126947 A1 5/2009 King
2009/0139707 A1 6/2009 Berzin et al.
2009/0145614 A1 * 6/2009 Cook et al. ..... 166/387
2009/0173490 A1 7/2009 Dusterhoft et al.
2009/0211767 A1 8/2009 Nutley et al.
2009/0211770 A1 8/2009 Nutley et al.
2009/0242214 A1 10/2009 Foster et al.
2009/0255675 A1 10/2009 Casciaro
2009/0255690 A1 * 10/2009 Conner et al. ..... 166/387
2009/0308656 A1 12/2009 Chitwood et al.
2010/0071908 A1 3/2010 Bishop et al.
2010/0078180 A1 4/2010 O'Connor et al.
2010/0155050 A1 6/2010 Frazier
2010/0230094 A1 9/2010 Foster et al.
2010/0230902 A1 9/2010 Castillo et al.
2011/0005778 A1 1/2011 Foster et al.
2011/0036560 A1 2/2011 Vail, III et al.
2011/0036561 A1 2/2011 Bishop et al.
2011/0259587 A1 10/2011 Joseph et al.
2012/0037355 A1 2/2012 Bishop et al.
2012/0067564 A1 3/2012 Mack et al.

(56) References Cited

U.S. PATENT DOCUMENTS

| | | | |
|---|---|---|---|
| 2012/0119445 | A1 | 5/2012 | Castillo et al. |
| 2012/0305253 | A1 | 12/2012 | O'Malley |
| 2012/0312559 | A1 | 12/2012 | Bailey et al. |

OTHER PUBLICATIONS

D.D. Onan, et al., Elastomeric Composites for Use in Well Cementing Operations, Oct. 3-6, 1993, pp. 593-608, SPE 26572, Society of Petroleum Engineers, Inc., U.S.A.

Thomas W. Ray, High Pressure/High Temperature (HP/HT) Seals for Oil and Gas Production, Feb. 17-19, 1998, pp. 603-614, SPE 39573, Society of Petroleum Engineers, Inc., U.S.A.

Product Report, ZXP Compression Set Liner Packer, Sep. 2001, Baker Hughes Incorporated, Houston, Texas, USA.

Gordon Mackenzie, et al., Wellbore Isolation Intervention Devices Utilizing a Metal-to-Metal Rather Than an Elastomeric Sealing Methodology, Nov. 11-14, 2007, pp. 1-5, SPE 109791, Society of Petroleum Engineers, Inc., U.S.A.

S. Yakeley, et al., Swellable Packers for Well Fracturing and Stimulation, Nov. 11, 2007, pp. 1-7, SPE 110621, Society of Petroleum Engineers, U.S.A.

King, George E., Permanent and Retrievable Packer Removal,Mar. 14, 2009, pp. 1-35, George E. King Engineering, Inc., USA.

* cited by examiner

PACKING ELEMENT BACKUP SYSTEM

BACKGROUND

1. Field of Invention

The invention is directed to packing element systems for use in a work or tool string disposed in a wellbore to isolate one or more zones of the wellbore from one or more other zones in the wellbore.

2. Description of Art

Referring to FIG. 1, prior packing element systems 200 include a housing or mandrel 211 with a packing element 212 disposed thereon. Each end of packing element 212 includes housing or support 213 to facilitate elastic expansion of packing element 212 away from mandrel 211 when an axial load is placed on packing element 212 at axial load points 214. Each end of packing element 212 also includes two back-up elements 215, 216 each of which are shown as two metal petal back-ups having bottom petal back-up 217 and top petal back-up 218, or a phenolic back-up (not shown) which is known in the art. A Teflon® barrier is also known to be included in the case of a metal petal back-up element.

SUMMARY OF INVENTION

Broadly, the packing element systems disclosed herein comprise a sealing element having a support system. The support system can include one or more of a first spacer ring, a second spacer ring, a third spacer ring, a mesh ring, and one or more petal rings. One or more of these components can be disposed at one or both of the upper end and/or lower end of the sealing element. When compressed, the sealing element is moved radially outward to engage an inner wall surface of a wellbore due to compressive forces of the one or more spacer ring(s), mesh ring, and/or petal ring(s). In certain embodiments, the lower end of one or more of the mesh ring(s) and/or petal ring(s) rotate outwardly toward the casing and, in certain embodiments, engage the casing to facilitate creation of the seal.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
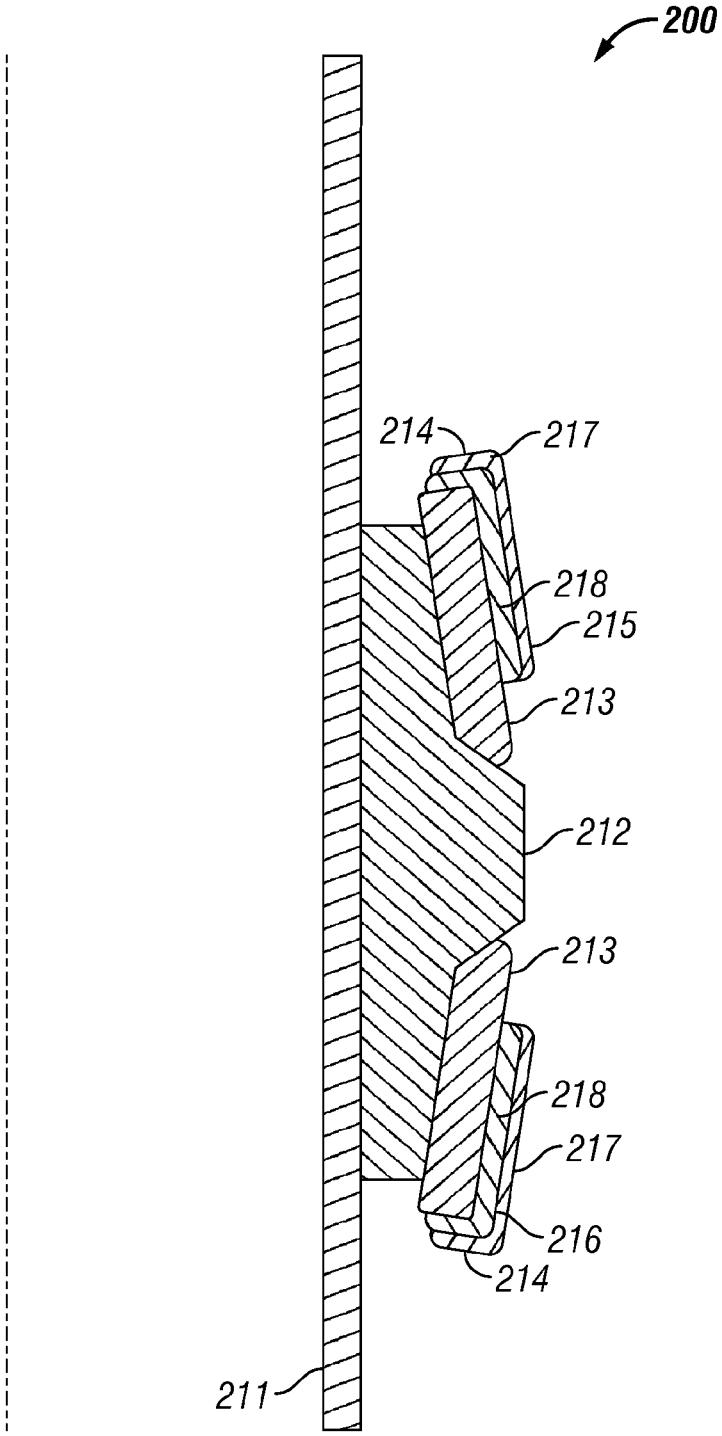
FIG. 1 (Prior Art)
FIG. 1 is a cross-sectional view of a prior art packing element system.
Figure 2:
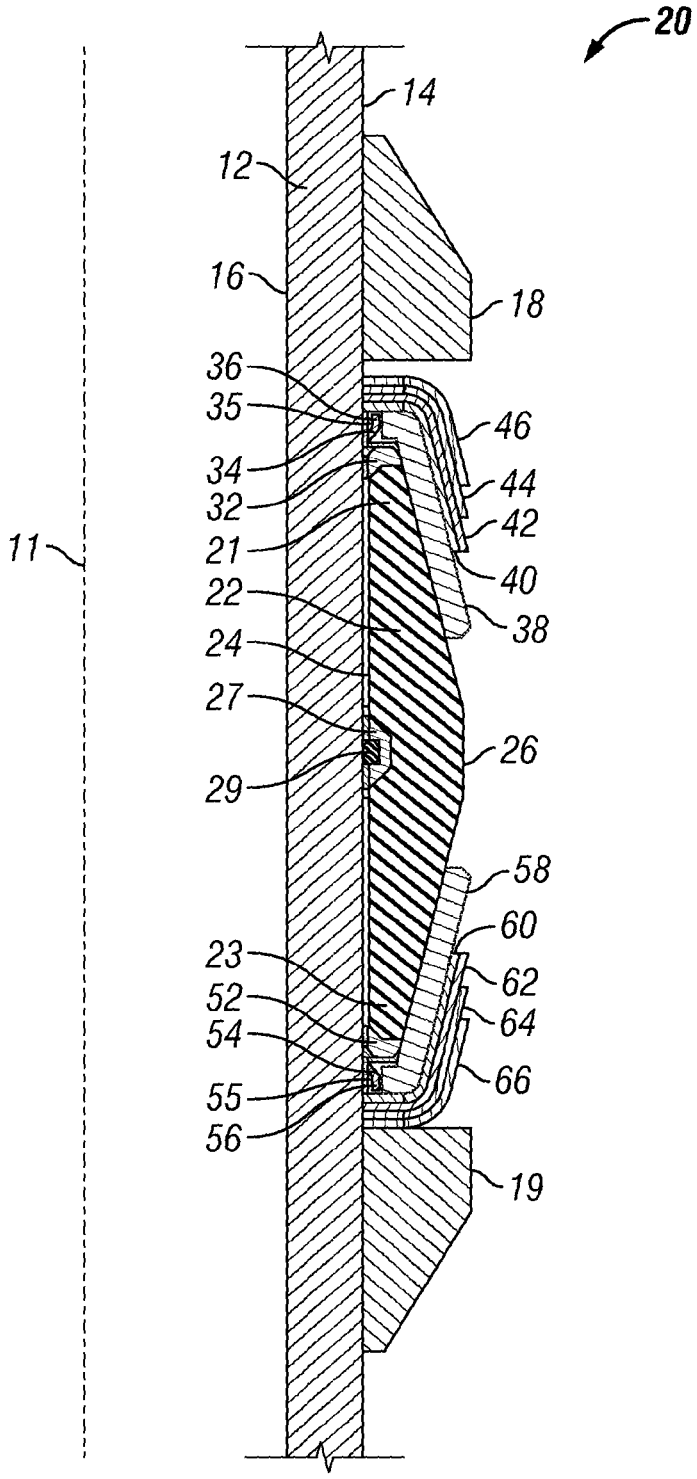
FIG. 2 is a cross-sectional view of a specific embodiment of a packing element system disclosed herein shown in its initial or run-in position.
Figure 3:
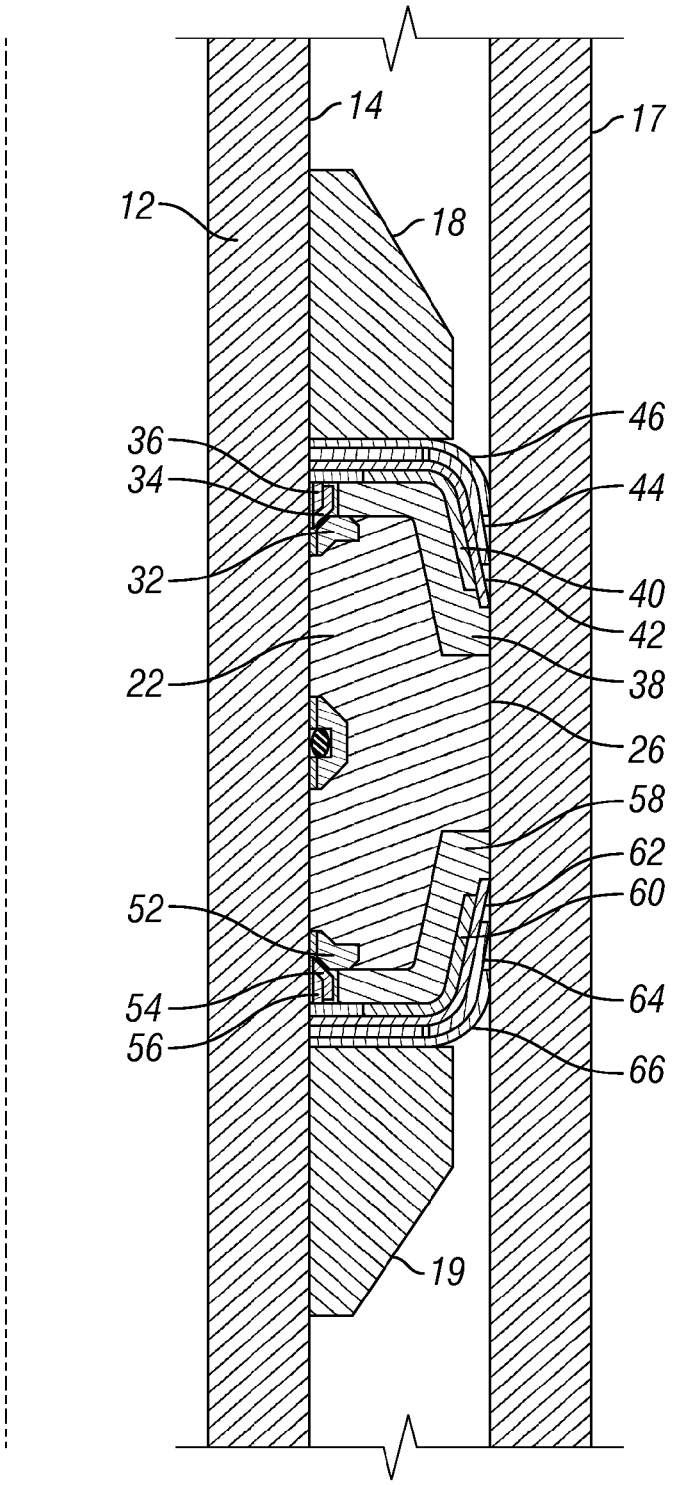
FIG. 3 is a cross-sectional view of the packing element system illustrated in FIG. 2 shown in its set position.

Referring now to FIGS. 2-3, packing element system 20 is shown in its initial or run-in position (FIG. 2) and its set position (FIG. 3). Broadly, packing element system 20 comprises sealing element 22 having a back-up or support system (discussed in greater detail below), upper support member 18, and lower support member 19, all carried on outer wall surface 14 of mandrel 12. Mandrel 12 includes inner wall surface 16 which defines longitudinal axis 11.

Sealing element 22, as well as the components of the support system, upper support member 18, and lower support member 19 are tubular members, each having an inner surface determined by an inner diameter that receives mandrel 12. As will be appreciated by persons of ordinary skill in the art, mandrel 12 is a tubular member carried on a casing string (not shown). Mandrel 12 can be secured to the casing string through any device or method known to persons of ordinary skill in the art.

Sealing element 22 comprises sealing element upper end 21, sealing element lower end 23, sealing element inner wall surface 24, and sealing element outer wall surface 26. Sealing element 22 may be formed of any material known by persons of ordinary skill in the art such as elastomers, rubbers, polymers, or thermoplastics. In one specific embodiment, sealing element 22 is formed of 95 durometer Nitrile. Additionally, sealing element 22 may have any shape desired or necessary to provide the requisite compression, deformation, or "extrusion" to form the seal with the inner wall surface of casing 17 (FIG. 3). As shown in FIGS. 2-3, in a preferred embodiment, sealing element 22 is formed into the shape of a sleeve.

In the embodiment of FIGS. 2-9, sealing element inner wall surface 22 is supported by o-ring member 27, and filler ring member 29. O-ring and filler ring members 27, 29 provide support to sealing element 22 and facilitate expansion of sealing element 22 radially outward away from longitudinal axis 11 of mandrel 12 during movement from the run-in position (FIG. 2) to the set position (FIG. 3), as well as provide a seal along mandrel outer wall surface 14 while running in the well.

Disposed on mandrel outer wall surface 14 adjacent to and above sealing element upper end 21 is first upper spacer ring 32, and disposed on mandrel outer wall surface 14 adjacent to and below sealing element lower end 22 is first lower spacer ring 52. In the embodiment of FIGS. 2-9, first upper spacer ring 32 and first lower spacer ring 52 are identical and will be discussed in greater detail with respect to FIG. 7. It is to be understood, however, that first upper and lower spacer rings 32, 52 are not required to be identical. Nor are both required to be included as part of packing element system 20.

Disposed on mandrel outer wall surface 14 adjacent to and above first upper spacer ring 32 is second upper spacer ring 34, and disposed on mandrel outer wall surface 14 adjacent to and below first lower spacer ring 52 is second lower spacer ring 54. In the embodiment of FIGS. 2-9, second upper spacer ring 34 and second lower spacer ring 54 are identical and will be discussed in greater detail with respect to FIGS. 8-9. It is to be understood, however, that second upper and lower spacer rings 34, 54 are not required to be identical. Nor are both required to be included as part of packing element system 20.

Disposed on mandrel outer wall surface 14 within upper cavity 35 defined by second upper spacer ring 34 is third upper spacer ring 36. Disposed on mandrel outer wall surface 14 within lower cavity 55 defined by second lower spacer ring 54 is third lower spacer ring 56. In the embodiment of FIGS. 2-9, third upper spacer ring 36 and third lower spacer ring 56 are identical. It is to be understood, however, that third upper and lower spacer rings 36, 56, are not required to be identical. Nor are both required to be included as part of packing element system 20. Third upper and lower spacer rings 36, 56 can be formed out of a metal and can have a rectangular cross-section (FIGS. 2-3). Alternatively, third upper and lower spacer rings 36, 56 can have any other shape, or formed out of any other material, desired or necessary to sufficiently fill upper and lower cavities 35, 55 and to provide sufficient support to second upper and lower spacer rings 34, 54 to facilitate moving sealing element 22 from its run-in position (FIG. 2) to its set position (FIG. 3).

Disposed on second upper spacer ring outer wall surface 103 (FIGS. 8-9) is upper mesh ring 38. Disposed on second lower spacer ring outer wall surface 103 (FIGS. 8-9) is lower mesh ring 58. As illustrated in FIGS. 2-3, upper and lower mesh rings 38, 58 include flared side walls that receive first upper and lower spacer rings 32, 52, a portion of second upper and lower spacer rings 34, 54, and sealing element upper and lower ends 21, 23, respectively. As further shown in FIGS. 2-3, upper and lower mesh rings 38, 58 also include opening 84 (FIG. 6) into which a portion of upper and lower second spacer rings 34, 54 are disposed and into which upper and lower third spacer rings 36, 56 are disposed, respectively.

Disposed on mandrel outer wall surface 14 adjacent to and above upper mesh ring 38 is first upper petal ring 40. Disposed on mandrel outer wall surface 14 adjacent to and below mesh ring 58 is first lower petal ring 60. As illustrated in FIGS. 2-5, first upper and lower petal rings 40, 60 include flared side walls that receive portions of first upper and lower mesh rings 38, 58, respectively. In the embodiment of FIGS. 2-9, first upper petal ring 40 and first lower petal ring 60 are identical and will be discussed in greater detail with respect to FIGS. 4-5. It is to be understood, however, that first upper and lower petal rings 40, 60 are not required to be identical. Nor are both required to be included as part of packing element system 20.

Disposed on mandrel outer wall surface 14 adjacent to and above first upper petal ring 40 is second upper petal ring 42. Disposed on mandrel outer wall surface 14 adjacent to and below first lower petal ring 60 is second lower petal ring 62. As illustrated in FIGS. 2-5, second upper and lower petal rings 42, 62 include flared side walls that receive portions of first upper and lower petal rings 40, 60, respectively. In the embodiment of FIGS. 2-9, second upper petal ring 42 and second lower petal ring 62 are identical and will be discussed in greater detail with respect to FIGS. 4-5. It is to be understood, however, that second upper and lower petal rings 42, 62 are not required to be identical. Nor are both required to be included as part of packing element system 20.

Disposed on mandrel outer wall surface 14 adjacent to and above second upper petal ring 42 is third upper petal ring 44. Disposed on mandrel outer wall surface 14 adjacent to and below second lower petal ring 62 is third lower petal ring 64. As illustrated in FIGS. 2-5, third upper and lower petal rings 44, 64 include flared side walls that receive portions of second upper and lower petal rings 42, 62, respectively. In the embodiment of FIGS. 2-9, third upper petal ring 44 and third lower petal ring 64 are identical and will be discussed in greater detail with respect to FIGS. 4-5. It is to be understood, however, that third upper and lower petal rings 44, 64 are not required to be identical. Nor are both required to be included as part of packing element system 20.

Disposed on mandrel outer wall surface 14 adjacent to and above third upper petal ring 44 is fourth upper petal ring 46. Disposed on mandrel outer wall surface 14 adjacent to and below third lower petal ring 64 is fourth lower petal ring 66. As illustrated in FIGS. 2-5, fourth upper and lower petal rings 46, 66 include flared side walls that receive portions of third upper and lower petal rings 44, 64, respectively. In the embodiment of FIGS. 2-9, fourth upper petal ring 46 and fourth lower petal ring 66 are identical and will be discussed in greater detail with respect to FIGS. 4-5. It is to be understood, however, that fourth upper and lower petal rings 46, 66 are not required to be identical. Nor are both required to be included as part of packing element system 20.

As illustrated in the embodiment of FIGS. 2-3, first, second, third, and fourth upper petal rings 40, 42, 44, 46 are "nested" or layered together such that first upper petal ring 40 is disposed within second upper petal ring 42, which is disposed within third upper petal ring 44, which is disposed in fourth upper petal ring 46. Similarly in this embodiment, first, second, third, and fourth lower petal rings 60, 62, 64, 66 are "nested" or layered together such that first lower petal ring 60 is disposed within second lower petal ring 62, which is disposed within third lower petal ring 64, which is disposed in fourth lower petal ring 44.

Figure 4:
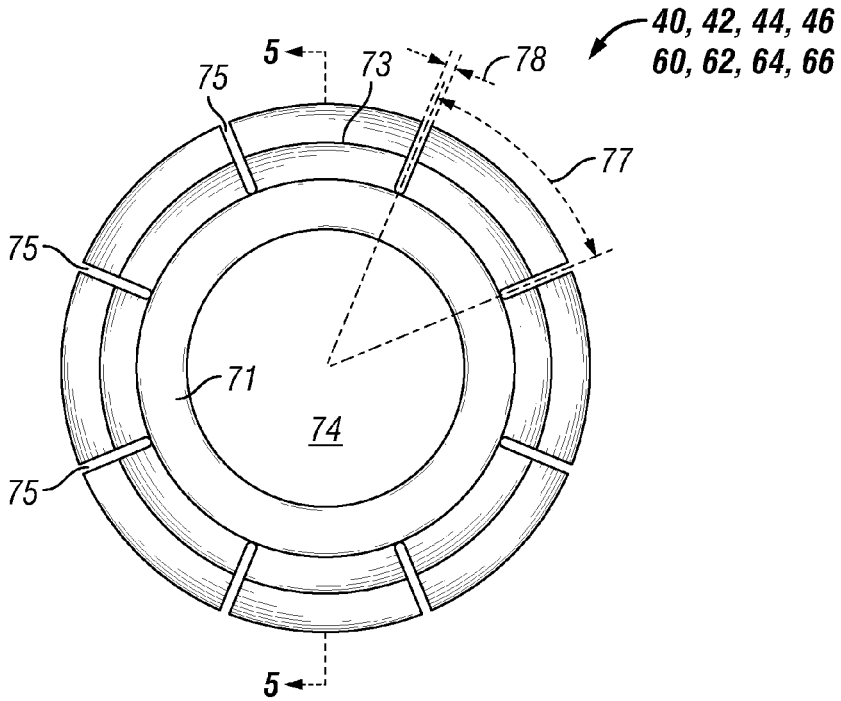
FIG. 4 is a top view of one specific embodiment of a petal ring for inclusion in the packing element systems disclosed herein.
Figure 5:
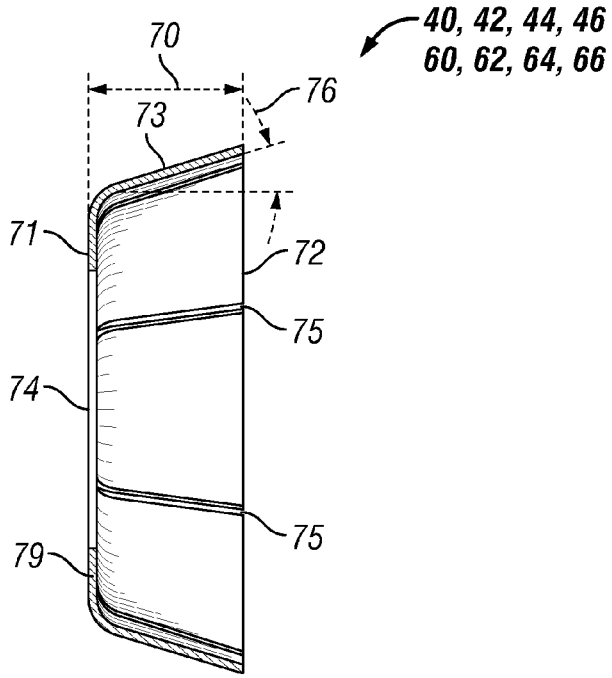
FIG. 5 is a partial cross-sectional view of the petal ring shown in FIG. 4.

Referring now to FIGS. 4-5, first, second, third, fourth upper petal rings 40, 42, 44, 46 and first, second, third, fourth lower petal rings 60, 62, 64, 66 are described in greater detail. In the various embodiments of packing element system 20 disclosed herein, the differences, if any, between or among one or more of first, second, third, fourth upper petal rings 40, 42, 44, 46 and first, second, third, fourth lower petal rings 60, 62, 64, 66 are directed to the dimensions of each petal ring.

First, second, third, fourth upper petal rings 40, 42, 44, 46 and first, second, third, fourth lower petal rings 60, 62, 64, 66 comprise upper end 71, lower end 72, and side wall or side wall surface 73. Side wall 73 is flared outwardly from upper end 71 to lower end 72 at angle 76 so that the opening in lower end 72 is larger than opening 74 disposed in upper end 71. Angle 76 is in the range from about 13 degrees to about 15 degrees and opening 74 has a diameter substantially equal to the outer diameter of mandrel 12.

Upper end 71 includes upper end surface 79. In the specific embodiment of FIGS. 2-9, upper end surface 79 is angled relative to opening 74 so that, when first, second, third, fourth upper petal rings 40, 42, 44, 46 and first, second, third, fourth lower petal rings 60, 62, 64, 66 are disposed on mandrel outer wall surface 14, upper end surface 79 is substantially perpendicular to longitudinal axis 11 of mandrel 12.

Disposed within side wall surface 73 are one or more slots 75. Each slot 75 has width 78 in the range from about 0.050 inches to about 0.070 inches. Each slot 75 is disposed at angle 77 from adjacent slots 75. Angle 77 is in the range from about 35 degrees to about 55 degrees. Height 70 is in the range from about 0.065 inches to about 1.300 inches where the downhole tool is a 5 inch bridge plug.

In one specific embodiment, first, second, third, fourth upper petal rings 40, 42, 44, 46 have dimensions such that, when nested or layered together, a portion of upper mesh ring 38 is not covered by first upper petal ring 40, a portion of first upper petal ring 40 is not covered by second upper petal ring 42, a portion of second upper petal ring 42 is not covered by third upper petal ring 44, and a portion of third upper petal ring 44 is not covered by fourth upper petal ring 46 (FIG. 2). Similarly, in certain embodiments, first, second, third, fourth lower petal rings 60, 62, 64, 66 have dimensions such that, when nested or layered together, a portion of lower mesh ring 58 is not covered by first lower petal ring 60, a portion of first lower petal ring 60 is not covered by second lower petal ring 62, a portion of second lower petal ring 62 is not covered by third lower petal ring 64, and a portion of third lower petal ring 64 is not covered by fourth lower petal ring 66 (FIG. 2).

In another specific embodiment, one or more of first, second, third, fourth upper petal rings 40, 42, 44, 46 are disposed relative to each other such that the corresponding slot(s) 75 of each of the upper petal rings are indexed so that the slot(s) of one upper petal ring does/do not align with the slot(s) of the next upper petal ring. In one particular embodiment, the slot(s) of each upper petal ring are indexed in the range from about 20 degrees to about 90 degrees. In one other particular embodiments, the slot(s) of each upper petal ring are indexed in the range from about 20 degrees to about 50 degrees. In one specific embodiment, the slot(s) of each upper petal ring are indexed 22.5 degrees relative to the subsequent upper petal ring.

In other embodiments, the first, second, third, fourth lower petal rings 60, 62, 64, 66 are indexed in the same manner as first, second, third, fourth upper petal rings, 40, 42, 44, 46. In still other embodiments, all of first, second, third, fourth upper petal rings, 40, 42, 44, 46 and first, second, third, fourth lower petal rings 60, 62, 64, 66 are indexed in this manner.

First, second, third, fourth upper petal rings 40, 42, 44, 46 and first, second, third, fourth lower petal rings 60, 62, 64, 66 can be formed of any material known or desired to provide sufficient support to sealing element 22 during movement of sealing element 22 from the run-in position (FIG. 2) to the set position (FIG. 3) and to facilitate creation of a suitable seal with the inner wall surface of casing 17. In one particular embodiment, first, second, third, fourth upper petal rings 40, 42, 44, 46 and first, second, third, fourth lower petal rings 60, 62, 64, 66 are formed from a metal such as steel or titanium.

Figure 6:
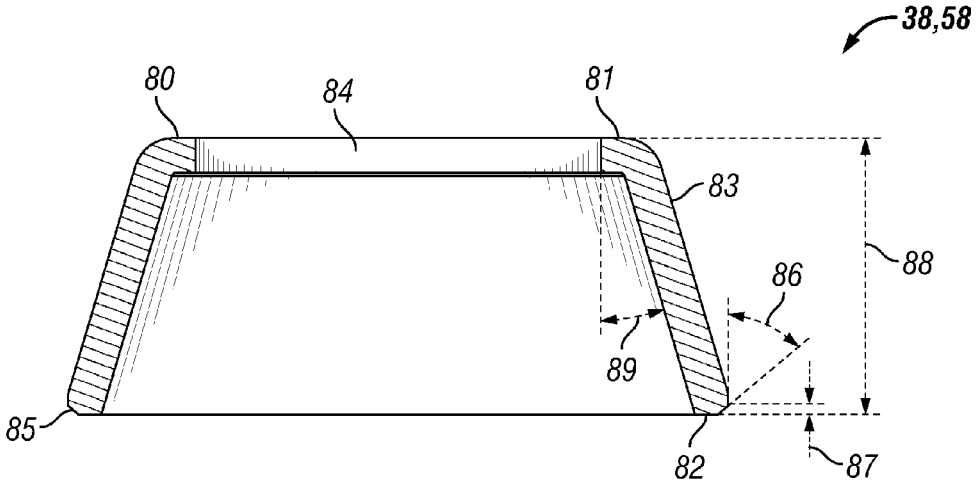
FIG. 6 is a partial cross-sectional view of one specific embodiment of a mesh ring for inclusion in the packing element systems disclosed herein.

Referring now to FIG. 6, upper and lower mesh rings 38, 58 are described in greater detail. In the various embodiments of packing element system 20 disclosed herein, the differences, if any, between upper and lower mesh rings 38, 58 are directed to the dimensions of each mesh ring.

Upper and lower mesh rings 38, 58 comprise upper end 81, lower end 82, and side wall or side wall surface 83. Side wall 83 is flared outwardly from upper end 81 to lower end 82 at angle 89 so that the opening in lower end 82 is larger than opening 84 disposed in upper end 81. Angle 89 is in the range from about 13 degrees to about 15 degrees and opening 84 has a diameter substantially equal to the outer diameter of mandrel 12.

Upper end 81 include upper end surface 80. In the specific embodiment of FIGS. 2-9, upper end surface 80 is angled relative to opening 84 so that, when upper and lower mesh rings 38, 58 are disposed on mandrel outer wall surface 14, upper end surface 80 is substantially perpendicular to longitudinal axis 11 of mandrel 12.

Lower end 82 includes bevel 85 disposed at height 87 above lower end 82 and at angle 86. Angle 86 is in the range from about 35 degrees to about 55 degrees and height 87 is in the range from about 0.040 inches to about 0.060 inches. Height 88 is in the range from about 1.500 inches to about 1.7500 inches where the downhole tool is a 5 inch bridge plug.

Upper and lower mesh rings 38, 58 can be formed of any material known or desired to provide sufficient support to sealing element 22 during movement of sealing element 22 from the run-in position (FIG. 2) to the set position (FIG. 3) and to facilitate creation of a suitable seal with the inner wall surface of casing 17. In one particular embodiment, upper and lower mesh rings 38, 58 are formed from a metal mesh such as steel or titanium.

Figure 7:
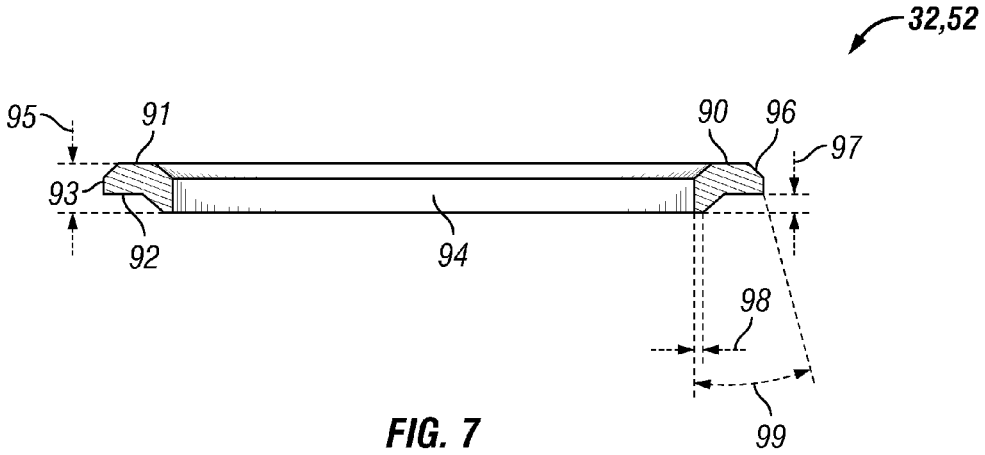
FIG. 7 is a partial cross-sectional view of one specific embodiment of a first spacer ring for inclusion in the packing element systems disclosed herein.

Referring now to FIG. 7, first upper and lower spacer rings 32, 52 are described in greater detail. In the various embodiments of packing element system 20 disclosed herein, the differences, if any, between first upper and lower spacer rings 32, 52 are directed to the dimensions of each first spacer ring.

First upper and lower spacer rings 32, 52 comprise upper end 91, lower end 92, and side wall or side wall surface 93. Height 95 between upper end 91 and lower end 92 is in the range from about 0.150 inches to about 0.250 inches.

Side wall 93 is profiled to have a top beveled portion toward upper end 91 and a lower beveled portion 96. Lower beveled portion 96 is disposed at angle 99 relative to the inner wall surface of upper and lower first spacer rings 32, 52. Angle 99 is in the range from about 13 degrees to about 15 degrees.

Lower end 92 is profiled to include a flat portion that intersects side wall surface 93 and an angled portion that connects the flat portion intersecting side wall surface 93 with a second flat portion intersecting with the inner wall surface of first upper and lower spacer rings 32, 52. This second flat portion has a width in the range from about 0.050 inches to about 0.070 inches. Depth 97 of the lower angled portion as measured from the second flat portion of lower end 92 to the first flat portion of lower end 92 is in the range from about 0.065 inches to about 0.085 inches.

Opening 94 is defined by an inner wall surface and includes a beveled portion toward upper end 91 Opening 94 has a diameter that is substantially identical to the outer diameter of mandrel 12. Upper end 91 include upper end surface 90. In the specific embodiment of FIGS. 2-9, upper end surface 90 is angled relative to opening 94 so that, when first upper and lower spacer rings 32, 52 are disposed on mandrel outer wall surface 14, upper end surface 90 is substantially perpendicular to longitudinal axis 11 of mandrel 12.

First upper and lower spacer rings 32, 52 can be formed of any material known or desired to provide sufficient support to sealing element 22 during movement of sealing element 22 from the run-in position (FIG. 2) to the set position (FIG. 3) and to facilitate creation of a suitable seal with the inner wall surface of casing 17. In one particular embodiment, first upper and lower spacer rings 32, 52 are formed from an elastomer or polymeric material such as polytetrafluoroethylene ("PTFE").

Figure 8:
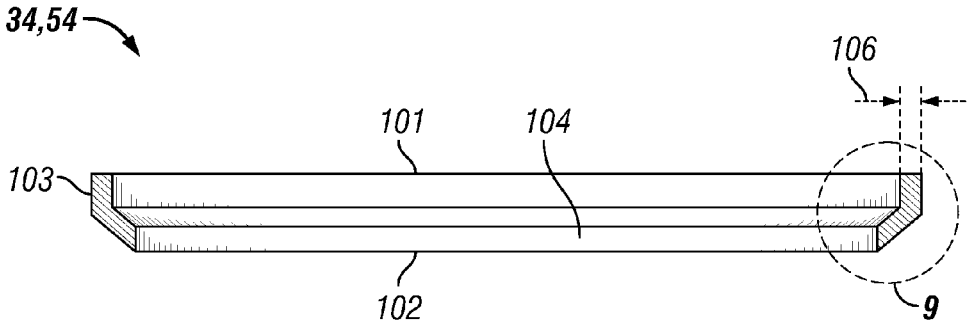
FIG. 8 is a partial cross-sectional view of one specific embodiment of a second spacer ring for inclusion in the packing element systems disclosed herein.
Figure 9:
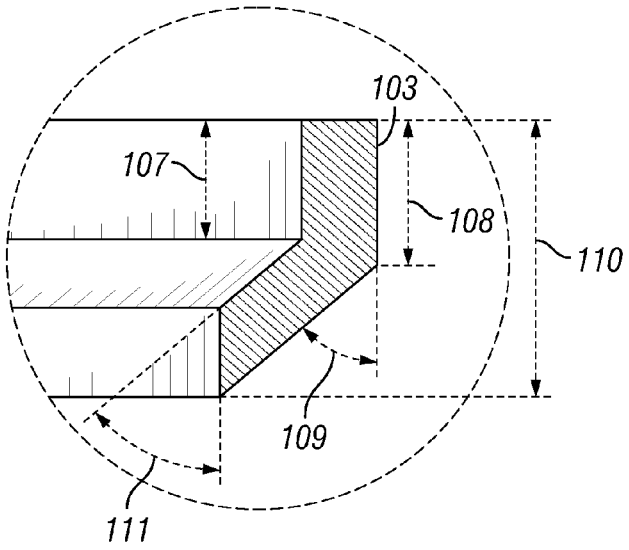
FIG. 9 is a portion of the partial cross-sectional view of the second spacer ring shown in FIG. 8 taken along line 9.

Referring now to FIGS. 8-9, second upper and lower spacer rings 34, 54 are described in greater detail. In the various embodiments of packing element system 20 disclosed herein, the differences, if any, between second upper and lower spacer rings 34, 54 are directed to the dimensions of each second spacer ring.

Second upper and lower spacer rings 34, 54 comprise upper end 101, lower end 102, outer wall surface 103, and inner wall surface 104 defining opening through which mandrel 12 is disposed. The opening has a diameter that is substantially identical to the outer diameter of mandrel 12. Height 110 from upper end 101 to lower end 102 is in the range from about 0.200 inches to about 0.240 inches.

Outer wall surface 103 and inner wall surface 104 are profiled to define cavity 35, 55 (FIG. 2-3) when mandrel 12 is disposed within the opening defined by inner wall surface 104. Thickness 106 between outer wall surface 103 and inner wall surface 104 is in the range from about 0.090 inches to about 0.110 inches.

Outer wall surface 103 includes an upper portion having height 108 in the range from about 0.100 inches to about 0.1300 inches and an angled lower portion that connects the upper portion with lower end 102. The angled lower portion of outer wall surface 103 is disposed at angle 109 relative to the upper portion of outer wall surface 103. Angle 109 is in the range from about 35 degrees to about 55 degrees.

Inner wall surface 104 includes an upper portion that is parallel to the upper portion of outer wall surface 103, an angled portion that is parallel to the angled portion of outer wall surface 104, and an interface portion that is substantially parallel to the upper portion of inner wall surface 104 and which, in the embodiment of FIGS. 2-9, engages or contacts mandrel outer wall surface 14. As shown in FIGS. 2, 3, 8, and 9, the angled portion of inner wall surface 104 connects upper portion of inner wall surface 104 with the interface portion of inner wall surface 104 and the interface portion of inner wall surface 104 connects lower end 102 with the angled portion of inner wall surface 104. The upper portion of inner wall surface 104 has height 107 in the range from about 0.080 inches to about 0.110 inches.

The interface portion of inner wall surface 104 is disposed at angle 111 relative to the angled portion of inner wall surface 104. Angle 111 is in the range from about 35 degrees to about 45 degrees so that the interface portion is substantially parallel to longitudinal axis 11 of mandrel 12 when third upper and lower spacer rings 34, 54 are disposed on mandrel outer wall surface 14.

Second upper and lower spacer rings 34, 54 can be formed of any material known or desired to provide sufficient support to sealing element 22 during movement of sealing element 22 from the run-in position (FIG. 2) to the set position (FIG. 3) and to facilitate creation of a suitable seal with the inner wall surface of casing 17. In one particular embodiment, second upper and lower spacer rings 34, 54 are formed from an elastomer or polymeric material such as polyetheretherketone ("PEEK").

Upper support member 18 and lower support member 19 may be any shape desired or necessary to provide transference of an axial load on outermost metal petal rings 46, 66. As shown in FIGS. 2-3, both upper support member 18 and lower support member 19 are cones. In other embodiments, only one of upper support member 18 or lower support member 19 is a cone. In still other embodiments, one or both of upper support member 18 and/or lower support member 19 have rectangular-shaped cross sections. In still another embodiment, one of upper support member 18 or lower support member 19 is rectangular-shaped and the other of upper support member 18 or lower support member 19 is a piston-shaped sleeve.

In one particular embodiment, upper support member 18 and lower support member 19 are slidable relative to each other along outer wall surface 14 of mandrel 12. In another specific embodiment, one of upper support member 18 or lower support member 19 is fixed to mandrel 12 against movement. In still another embodiment, both upper support member 18 and lower support member 19 are stationary.

Upper support member 18 and lower support member 19 are rigid members formed from any material known by persons of ordinary skill in art, including, but not limited to, glass or carbon reinforced phenolic or metals such as steel. In embodiments in which the axial load is applied in only one direction, one of the upper support member 18 or lower support member 19 may be formed of a material that is less strong than the material used to form the cone that is directly receiving the axial load.

In operation, after packing element system 20 is disposed within a wellbore at the desired depth and location, packing element system 20 is actuated in the same manner as any other packer or packing element system known to persons of ordinary skill in the art, such as by applying a force to upper support member 18 axially in the downward direction in FIGS. 2-3 while lower support member 19 is stationary. Such axial load may also be applied in the opposite direction on lower support member 19 while upper support member 18 is stationary or in both directions to both upper support member 18 and lower support member 19 with neither upper support member 18 nor lower support member 19 being stationary. Alternatively, a radial force can be applied to mandrel 12 to radially expand mandrel 12 and thus, compress upper and lower petal rings 40, 42, 44, 46, 60, 62, 64, 66, mesh back-up rings 38, 58, and, thus sealing element 22, between stationary upper and lower support members 18, 19.

Regardless of how packing element system 20 is actuated, during actuation, sealing element 22 is moved radially outward from longitudinal axis 11 of mandrel 12. In so doing, lower end 82 of upper and lower mesh rings 38, 58 are rotated outward toward the inner wall surface of casing 17. Similarly, lower end 72 of one or more of upper or lower petal rings 40, 42, 44, 46, 60, 62, 64, 66 can also be rotated outwardly toward the inner wall surface of casing 17. In certain embodiments, one or both lower end 83 of upper or lower mesh rings 38, 58 engages with the inner wall surface of casing 17 to facilitate creation of a seal. In still other embodiments, one or more lower ends 72 of upper or lower petal rings 40, 42, 44, 46, 60, 62, 64, 66 engages with the inner wall surface of casing 17 to facilitate creation of a seal.

It is to be understood that the invention is not limited to the exact details of construction, operation, exact materials, or embodiments shown and described, as modifications and equivalents will be apparent to one skilled in the art. For example, the materials forming the components and the dimensions of each of the components can be modified as desired or necessary effectuate the best seal for the target environment. Moreover, not all of the components described with respect to the embodiments of FIGS. 2-9 are required to provide a suitable seal against an inner wall surface of casing 17. Nor are the same components required to be included at both the upper end and the lower end of the sealing element. To the contrary, the components at the upper end of the sealing element can be different in number, dimension, or order from those at the lower end of sealing element.

Further, it is to be understood that the term "wellbore" as used herein includes open-hole, cased, or any other type of wellbores. In addition, the use of the term "well" is to be understood to have the same meaning as "wellbore." Moreover, in all of the embodiments discussed herein, upward, toward the surface of the well (not shown), is toward the top of Figures, and downward or downhole (the direction going away from the surface of the well) is toward the bottom of the Figures. However, it is to be understood that the tools may have their positions rotated in either direction any number of degrees. Accordingly, the tools can be used in any number of orientations easily determinable and adaptable to persons of ordinary skill in the art. In addition, embodiments having only one or more "upper" component(s) or only one or more "lower" component(s) are not to be construed as requiring that/those components to be closer to the well surface (in the case of the use of "upper") or to be further away from the well surface (in the case of the use of "lower"). The invention is therefore to be limited only by the scope of the appended claims.

What is claimed is:

1. A packing element system for a downhole tool comprising:

a mandrel having a mandrel outer wall surface;

a rigid upper supporting member operatively associated with the mandrel outer wall surface;

a rigid lower supporting member operatively associated with the mandrel below the upper supporting member;

a sealing element operatively associated with the mandrel outer wall surface between the upper supporting member and the lower supporting member, the sealing element having a sealing element upper end, a sealing element lower end, a sealing element outer wall surface, and a sealing element inner wall surface;

a first upper spacer ring operatively associated with the mandrel outer wall surface adjacent to and above the upper end of the sealing element;

a second upper spacer ring operatively associated with the mandrel outer wall surface adjacent to and above the first upper spacer ring, the second upper spacer ring having a second upper spacer ring inner wall surface, a second upper spacer ring outer wall surface, a second upper spacer ring upper end, and a second upper spacer ring lower end, a first portion of the second upper spacer ring inner wall surface being operatively associated with the mandrel outer wall surface, and a second portion of the second upper spacer ring inner wall surface and the mandrel outer wall surface defining a first upper cavity;

a third upper spacer ring operatively associated with the mandrel outer wall surface, the third upper spacer ring being disposed within the first upper cavity;

an upper mesh ring partially disposed on the second upper spacer ring outer wall surface and partially disposed on the sealing element outer wall surface, the upper mesh ring having an upper mesh ring upper end having an upper mesh ring upper end surface defining an upper mesh ring upper end opening having an upper mesh ring upper end opening diameter;

an upper mesh ring lower end, and an upper mesh ring side wall surface, the upper mesh ring side wall surface connecting the upper mesh ring upper end with the upper mesh ring lower end and defining an upper mesh ring lower opening having an upper mesh ring lower opening diameter, the upper mesh ring lower opening diameter being greater than the upper mesh ring upper opening diameter; and a first upper petal ring partially disposed on the mandrel outer wall surface and partially disposed on the upper mesh ring side wall surface, the upper petal ring having a first upper petal ring upper end surface defining a first upper petal ring upper end opening having a first upper petal ring upper end opening diameter, a first upper petal ring lower end, and a first upper petal ring side wall surface, the first upper petal ring side wall surface connecting the first upper petal ring upper end with the first upper petal ring lower end and defining a first upper petal ring lower opening having a first upper petal ring lower opening diameter, the first upper petal ring lower opening diameter being greater than the first upper petal ring upper opening diameter, and the first upper petal ring side wall surface having at least one first upper petal side wall slot disposed therein.

2. The packing element system of claim 1, further comprising:

a second upper petal ring partially disposed on the mandrel outer wall surface and partially disposed on the first upper petal ring side wall surface, the second upper petal ring having a second upper petal ring upper end having a second upper petal ring upper end surface defining a second upper petal ring upper end opening having a second upper petal ring upper end opening diameter, a second upper petal ring lower end, and a second upper petal ring side wall surface, the second upper petal ring side wall surface connecting the second upper petal upper ring end with the second upper petal ring lower end and defining a second upper petal ring lower opening having a second upper petal ring lower opening diameter, the second upper petal ring lower opening diameter being greater than the second upper petal ring upper opening diameter, and the second upper petal ring side wall surface having at least one second upper petal side wall slot disposed therein.

3. The packing element system of claim 2, further comprising:

a third upper petal ring partially disposed on the mandrel outer wall surface and partially disposed on the second upper petal ring side wall surface, the third upper petal ring having a third upper petal ring upper end having a third upper petal ring upper end surface defining a third upper petal ring upper end opening having a third upper petal ring upper end opening diameter, a third upper petal ring lower end, and a third upper petal ring side wall surface, the third upper petal ring side wall surface connecting the third upper petal upper ring end with the third upper petal ring lower end and defining a third upper petal ring lower opening having a third upper petal ring lower opening diameter, the third upper petal ring lower opening diameter being greater than the third upper petal ring upper opening diameter, and the third upper petal ring side wall surface having at least one third petal side wall slot disposed therein.

4. The packing element system of claim 3, further comprising:

a fourth upper petal ring partially disposed on the mandrel outer wall surface and partially disposed on the third upper petal ring side wall surface, the fourth upper petal ring having a fourth upper petal ring upper end having a fourth upper petal ring upper end surface defining a fourth upper petal ring upper end opening having a fourth upper petal ring upper end opening diameter, a fourth upper petal ring lower end, and a fourth upper petal ring side wall surface, the fourth upper petal ring side wall surface connecting the fourth upper petal upper ring end with the fourth upper petal ring lower end and defining a fourth upper petal ring lower opening having a fourth upper petal ring lower opening diameter, the fourth upper petal ring lower opening diameter being greater than the fourth upper petal ring upper opening diameter, and the fourth upper petal ring side wall surface having at least one fourth upper petal side wall slot disposed therein.

5. The packing element system of claim 4, wherein the second upper petal ring, the third upper petal ring, and the fourth upper petal ring are disposed relative to one another wherein a portion of the third upper petal ring side wall surface is not covered by the fourth upper petal ring side wall surface, and a portion of the second upper petal ring side wall surface is not covered by the third upper petal ring side wall surface.

6. The packing element system of claim 4, wherein the one or more slots of the first upper petal ring are indexed approximately 22.5 degrees relative to the one or more slots of the second upper petal ring.

7. The packing element system of claim 1, wherein the upper mesh ring and the first upper petal ring are disposed relative to each other wherein a portion of the upper mesh ring side wall surface is not covered by the first upper petal ring.

8. The packing element system of claim 1, further comprising:

a first lower spacer ring disposed on the mandrel outer wall surface adjacent to and below the lower end of the sealing element;

a second lower spacer ring operatively associated with the mandrel outer wall surface adjacent to and below the first lower spacer ring, the second lower spacer ring having a second lower spacer ring inner wall surface, a second lower spacer ring outer wall surface, a second lower spacer ring upper end, and a second lower spacer ring lower end, a first portion of the second lower spacer ring inner wall surface being operatively associated with the mandrel outer wall surface, and a second portion of the second lower spacer ring inner wall surface and the mandrel outer wall surface defining a first lower cavity;

a third lower spacer ring disposed on the mandrel outer wall surface, the third lower spacer ring being disposed within the first lower cavity;

a lower mesh ring partially disposed on the first lower spacer ring outer wall surface and partially disposed on the sealing element outer wall surface, the lower mesh ring having a lower mesh ring upper end having a lower mesh ring upper end surface defining a lower mesh ring upper end opening having a lower mesh ring upper end opening diameter, a lower mesh ring lower end, and a lower mesh ring side wall surface, the lower mesh ring side wall surface connecting the lower mesh upper ring upper end with the lower mesh ring lower end and defining a lower mesh ring lower opening having a lower mesh ring lower opening diameter, the lower mesh ring lower opening diameter being greater than the lower mesh ring upper opening diameter; and a first lower petal ring partially disposed on the mandrel outer wall surface and partially disposed on the lower mesh ring side wall surface, the first lower petal ring having a first lower petal ring upper end having a first lower petal ring upper end surface defining a first lower petal ring upper end opening having a first lower petal ring upper end opening diameter, a first lower petal ring lower end, and a first lower petal ring side wall surface, the first lower petal ring side wall surface connecting the first lower petal upper ring end with the first lower petal ring lower end and defining a first lower petal ring lower opening having a first lower petal ring lower opening diameter, the first lower petal ring lower opening diameter being greater than the first lower petal ring upper opening diameter, and the first lower petal ring side wall surface having at least one first lower petal side wall slot disposed therein.

9. The packing element system of claim 8, wherein the upper mesh ring upper end surface is disposed substantially perpendicular to a longitudinal axis of the mandrel.

10. The packing element system of claim 9, wherein each of the first upper petal ring upper end surface, the second upper petal ring upper end surface, the third upper petal ring upper end surface, and the fourth upper petal ring upper end surface are disposed substantially perpendicular to a longitudinal axis of the mandrel.

11. The packing element system of claim 10, wherein the lower mesh ring upper end surface is disposed substantially perpendicular to a longitudinal axis of the mandrel.

12. The packing element system of claim 11, wherein each of the first lower petal ring upper end surface, the second lower petal ring upper end surface, the third lower petal ring upper end surface, and the fourth lower petal ring upper end surface are disposed substantially perpendicular to a longitudinal axis of the mandrel.

13. The packing element system of claim 8, further comprising:

a second upper petal ring partially disposed on the mandrel outer wall surface and partially disposed on the first upper petal ring side wall surface, the second upper petal ring having a second upper petal ring upper end having a second upper petal ring upper end surface defining a second upper petal ring upper end opening having a second upper petal ring upper end opening diameter, a second upper petal ring lower end, and a second upper petal ring side wall surface, the second upper petal ring side wall surface connecting the second upper petal upper ring end with the second upper petal ring lower end and defining a second upper petal ring lower opening having a second upper petal ring lower opening diameter, the second upper petal ring lower opening diameter being greater than the second upper petal ring upper opening diameter, and the second upper petal ring side wall surface having at least one second upper petal side wall slot disposed therein; and a second lower petal ring partially disposed on the mandrel outer wall surface and partially disposed on the first lower petal ring side wall surface, the second lower petal ring having a second lower petal ring upper end having a second lower petal ring upper end surface defining a second lower petal ring upper end opening having a second lower petal ring upper end opening diameter, a second lower petal ring lower end, and a second lower petal ring side wall surface, the second lower petal ring side wall surface connecting the second upper petal lower ring end with the second lower petal ring lower end and defining a second lower petal ring lower opening having a second lower petal ring lower opening diameter, the second lower petal ring lower opening diameter being greater than the second lower petal ring upper opening diameter, and the second lower petal ring side wall surface having at least one second lower petal side wall slot disposed therein.

14. The packing element system of claim 13, further comprising:

a third upper petal ring partially disposed on the mandrel outer wall surface and partially disposed on the second upper petal ring side wall surface, the third upper petal ring having a third upper petal ring upper end having a third upper petal ring upper end surface defining a third upper petal ring upper end opening having a third upper petal ring upper end opening diameter, a third upper petal ring lower end, and a third upper petal ring side wall surface, the third upper petal ring side wall surface connecting the third upper petal upper ring end with the third upper petal ring lower end and defining a third upper petal ring lower opening having a third upper petal ring lower opening diameter, the third upper petal ring lower opening diameter being greater than the third upper petal ring upper opening diameter, and the third upper petal ring side wall surface having at least one third upper petal side wall slot disposed therein; and a third lower petal ring partially disposed on the mandrel outer wall surface and partially disposed on the second lower petal ring side wall surface, the third lower petal ring having a third lower petal ring upper end having a third lower petal ring upper end surface defining a third lower petal ring upper end opening having a third lower petal ring upper opening diameter, a third lower petal ring lower end, and a third lower petal ring side wall surface, the third lower petal ring side wall surface connecting the third lower petal upper ring end with the third lower petal ring lower end and defining a third lower petal ring lower opening having a third lower petal ring lower opening diameter, the third lower petal ring lower opening diameter being greater than the lower upper petal ring upper opening diameter, and the third lower petal ring side wall surface having at least one third lower petal side wall slot disposed therein.

15. The packing element system of claim 14, further comprising:

a fourth upper petal ring partially disposed on the mandrel outer wall surface and partially disposed on the third upper petal ring side wall surface, the fourth upper petal ring having a fourth upper petal ring upper end having a fourth upper petal ring upper end surface defining a fourth upper petal ring upper end opening having a fourth upper petal ring upper end opening diameter, a fourth upper petal ring lower end, and a fourth upper petal ring side wall surface, the fourth upper petal ring side wall surface connecting the fourth upper petal ring upper ring end with the fourth upper petal ring lower end and defining a fourth upper petal ring lower opening having a fourth upper petal ring lower opening diameter, the fourth upper petal ring lower opening diameter being greater than the fourth upper petal ring upper opening diameter, and the fourth upper petal ring side wall surface having at least one fourth upper petal side wall slot disposed therein; and a fourth lower petal ring partially disposed on the mandrel outer wall surface and partially disposed on the third lower petal ring side wall surface, the fourth upper petal ring having a fourth lower petal ring upper end having a fourth lower petal ring upper end surface defining a fourth lower petal ring upper end opening having a fourth lower petal ring upper end opening diameter, a fourth lower petal ring lower end, and a fourth lower petal ring side wall surface, the fourth lower petal ring side wall surface connecting the fourth lower petal upper ring end with the fourth lower petal ring lower end and defining a fourth lower petal ring lower opening having a fourth lower petal ring lower opening diameter, the fourth lower petal ring lower opening diameter being greater than the fourth lower petal ring upper opening diameter, and the fourth lower petal ring side wall surface having at least one fourth lower petal side wall slot disposed therein.

16. A packing element system for a downhole tool comprising:

a mandrel having a mandrel outer wall surface;

a rigid upper supporting member operatively associated with the mandrel outer wall surface;

a rigid lower supporting member operatively associated with the mandrel below the upper supporting member;

a sealing element operatively associated with the mandrel outer wall surface between the upper supporting member and the lower supporting member;

an upper mesh ring comprising an upper mesh ring side wall downwardly flared for receiving an upper end portion of the sealing element within the upper mesh ring;

a lower mesh ring comprising a lower mesh ring side wall upwardly flared for receiving a lower end portion of the sealing element within the lower mesh ring;

at least one upper petal ring having an upper petal ring side wall and at least one upper petal ring slot, the upper petal ring side wall being downwardly flared for receiving a portion of the upper mesh ring;

at least one lower petal ring having a lower petal ring side wall and at least one lower petal ring slot, the lower petal ring side wall being upwardly flared for receiving a portion of the lower mesh ring;

a first upper spacing ring disposed on the mandrel outer wall surface between the upper portion of the sealing element and the upper mesh ring;

a second upper spacer ring disposed on the mandrel outer wall surface between the first upper spacer ring and the upper mesh ring, the second upper spacer ring comprising a second upper spacer ring inner wall surface, the second upper spacer ring inner wall surface and the mandrel outer wall surface defining an upper cavity;

a third upper spacer ring disposed on the mandrel outer wall surface, the third upper spacer ring being disposed within the upper cavity;

a first lower spacer ring disposed on the mandrel outer wall surface between the lower portion of the sealing element and the lower mesh ring;

a second lower spacer ring disposed on the mandrel outer wall surface between the first lower spacer ring and the lower mesh ring, the second lower spacer ring comprising a second lower spacer ring inner wall surface, the second lower spacer ring inner wall surface and the mandrel outer wall surface defining a lower cavity; and a third lower spacer ring disposed on the mandrel outer wall surface, the third lower spacer ring being disposed within the lower cavity.

17. The packing element system of claim 16, wherein four upper petal rings are nested together and four petal ring are nested together.

18. A method of sealing a wellbore, the method comprising the steps of:

(a) running a string into a wellbore, the string having a packing element system, the packing element system having a mandrel having a mandrel outer wall surface, a rigid upper supporting member operatively associated with the mandrel outer wall surface, a rigid lower supporting member operatively associated with the mandrel below the upper supporting member, a sealing element operatively associated with the mandrel outer wall surface between the upper supporting member and the lower supporting member, an upper mesh ring comprising an upper mesh ring side wall downwardly flared for receiving an upper end portion of the sealing element within the upper mesh ring, at least one upper petal ring having an upper petal ring side wall and at least one upper petal ring slot, the upper petal ring side wall being downwardly flared for receiving a portion of the upper mesh ring, a first upper spacer ring disposed on the mandrel outer wall surface between the upper portion of the sealing element and the upper mesh ring, a second upper spacer ring disposed on the mandrel outer wall surface between the first upper spacer ring and the upper mesh ring, the second upper spacer ring comprising a second upper spacer ring inner wall surface, the second upper spacer ring inner wall surface and the mandrel outer wall surface defining a cavity, and a third upper spacer ring disposed on the mandrel outer wall surface, the third upper spacer ring being disposed within the cavity; and (b) applying a load to the mandrel to force the first upper spacer ring into the sealing element causing the sealing element to move radially outward from a longitudinal axis of the mandrel into sealing engagement with an inner wall surface of the wellbore, and causing a portion of the upper mesh ring to rotate radially outward from the longitudinal axis of the mandrel.

19. The method of claim 18, wherein the load is applied axially in a first direction along the longitudinal length of the mandrel.

20. The method of claim 19, wherein the load is further applied axially in a second direction along the longitudinal length of the mandrel.

21. The method of claim 18, wherein the load is applied radially along the longitudinal length of the mandrel.

* * * * *